US006252172B1

(12) United States Patent
Tanigawa et al.

(10) Patent No.: US 6,252,172 B1
(45) Date of Patent: Jun. 26, 2001

(54) ELECTRICAL CABLE ADAPTED FOR HIGH-VOLTAGE APPLICATIONS

(75) Inventors: Hidemi Tanigawa; Takahiko Sugita; Yoshinao Kobayashi; Hiroshi Inoue, all of Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/348,581

(22) Filed: Jul. 7, 1999

(30) Foreign Application Priority Data

Jul. 13, 1998 (JP) ..... 10-197331

(51) Int. Cl.[7] ..... H01B 9/02

(52) U.S. Cl. ..... 174/102 SC; 174/105 R; 174/108; 338/214

(58) Field of Search ..... 174/102 SC, 105 R, 174/108, 120 SC; 338/66, 214

(56) References Cited

U.S. PATENT DOCUMENTS 3,191,132 6/1965 Mayer .
4,025,715 * 5/1977 Foley et al. ..... 174/120 SC X
4,800,359 1/1989 Yukawa et al. .
4,970,488 * 11/1990 Horiike et al. ..... 338/214
5,057,812 * 10/1991 Yukawa et al. ..... 338/66

FOREIGN PATENT DOCUMENTS 1333494 12/1994 (CA) .
644556 * 3/1995 (EP) .
0690459 1/1996 (EP) .
0766268 4/1997 (EP) .

* cited by examiner

*Primary Examiner*—Dean A. Reichard
*Assistant Examiner*—Chau N. Nguyen
(74) *Attorney, Agent, or Firm*—Greenblum & Bernstein, P.L.C.

(57) ABSTRACT

An electrical cable according to the present invention is suitable for high-voltage circuits used in fixed-type apparatuses such as office or home appliances. The cable includes a reinforcing thread, which is baked with a fluorocarbon rubber paint, to form a small-diameter cable core portion. The cable core portion is wound with a conductive wire having a wire core portion and a semi-electroconductive wire-coating. Because the conductive wire includes the semi-electroconductive coating, it can be wound densely. As a result, the electrical cable as a whole can be made thinner, while maintaining a high noise-suppressing effect.

4 Claims, 3 Drawing Sheets

ELECTRICAL CABLE ADAPTED FOR HIGH-VOLTAGE APPLICATIONS

BACKGROUND OF THE INVENTION

1. Field of the Invention

The invention relates to an electrical cable adapted for high-voltage applications. The electrical cable can be used with fixed apparatuses which are either permanently installed or stay at a given location, such as office equipment, home appliances, etc.. Such apparatuses may use or produce high voltages, in which case some parts of them can generate high-voltage noise. The present invention more particularly concerns electrical cables for the high-voltage circuits used in those parts susceptible of generating high-voltage noise.

2. Description of Background Information

Known electrical cables for high-voltage circuits may be classified into two categories. The first category includes a cable system in which copper-conductor cables are generally used, but in which downstream steps employ cables which contain a ferrite core in order to suppress noise (prior art 1). The second category includes a cable system that uses reinforcing cables made of an aramide fiber, a glass fiber or the like, on the surface of which conductive carbon is baked and adhered. With this type of cable, noise is suppressed by increasing the impedance of the carbon portion of the conductive cables (prior art 2).

It is also known that improved high-voltage breakdown resistance can be achieved by twisting together a plurality of conductive threads 1 to form a cable suitable for high-voltage circuits (FIG. 1). With this cable, the surface of the twisted conductive threads 1 is made uniformly smooth, so that electrical voltage is prevented from concentrating on particular points. To this end, the twisted conductive threads 1 are coated with an electrically conductive resin 2 through an extrusion process, and are then provided with an insulating coating 3 (prior art 3).

With this prior art 3, a material having a good high-voltage breakdown resistance and a good extrudability, such as low-density polyethylene (LDPE) or cross-linked LDPE, may be used as the insulating coating 3. However, pure polyethylene resins are inflammable. As it is now required that office or home appliances must be nonflammable, flame retarders are usually added to these resins to meet this requirement.

With a cable for high-voltage circuits which includes a ferrite core portion (prior art 1), it is difficult to suppress noise over a broad frequency spectrum. Therefore, additional means have to be adopted for effective noise suppression. However, these additional means involve extra costs, due to the supplementary manufacturing steps they require.

When a conductive cable is prepared by adhering carbon around a reinforcing thread through a baking process (prior art 2), the impedance may be set to a high level in order to remove high-voltage noise. However, the resulting conductive cable has a structure which does not form inductance elements, and therefore noise cannot be suppressed efficiently.

With prior art 3, the electrically conductive resin 2 will become thermally deteriorated after a long-term use, and fine cracks may form on the surface thereof. Then, the voltage will become concentrated in those cracks. When a high voltage is charged in this state, dielectric breakdowns may occur, and the conductive threads 1 can then no longer serve as a high-voltage cable.

In addition, the end portions of the electrical cable must be prepared for high-voltage circuits by connecting metal terminals thereto. In the case of prior art 3, the connections established during this preparation process can sometimes be made through the electrically conductive resin 2, which causes impedance fluctuations. The impedance may also vary after prolonged use, owing to the deterioration of electrically conductive resin 2. Moreover, the grip for holding the terminals may be weakened, with the high-voltage resistance subsequently being deteriorated.

Further yet, when a low-density polyethylene is used, as is the case with prior art 3, the electrical cable deforms at high temperatures. This may lead to some cable characteristics, such as its behavior during the so-called "high-voltage cutting-through test", to deviate from the standards adopted by Underwriter's Laboratories Inc. (UL Standards) in force in the United States. In such a case, a flame retarder can be added to make the cable more fireproof However, such an additive lowers the voltage breakdown resistance of the cable. A solution would be to maintain the breakdown resistance by making the insulating coating thicker. However, such a measure would be at the expense of the plasticity of the cable, the resulting electrical cable for high-voltage circuits then becoming less flexible.

SUMMARY OF THE INVENTION

An object of the invention is therefore to provide an electrical cable for high-voltage circuits, which can be used in fixed type machinery and tools. The cable according to the invention generates less noise, has a high electrical breakdown resistance, is nonflammable, and has a good formability.

To this end, there is provided an electrical cable for high-voltage circuits, the electrical cable being used in fixed type apparatuses. The electrical cable includes a reinforcing thread, and a cable core element for winding an electrically conductive wire therearound. The cable core element is formed by baking a fluorocarbon rubber paint mixed with a magnetic material, such that the fluorocarbon rubber paint mixed with the magnetic material is adhered around the reinforcing thread. A conductive wire, including a wire core portion and a semi-electroconductive wire-coating, is wound around the cable core element with a given number of spirals, and an insulating coating covers the conductive wire.

In this structure, the conductive wire has a diameter of about 40 $\mu$m at the most, and the number of spirals is at least about 12,000 spirals/m.

The electrical cable for high-voltage circuits may further include an inner coating having a semi-electroconductivity, the inner coating being located between the cable core element wound with the conductive wire and the insulating coating.

Preferably, the number of spirals is about 15,000 spirals/m.

Preferably yet, the cable core portion has a diameter of about 0.75 mm at the most.

There is also provided a method of preparing the electrical cable for high-voltage circuits. The method includes preparing the reinforcing thread, and baking the fluorocarbon rubber paint mixed with the magnetic material, such that the fluorocarbon rubber paint mixed with the magnetic material is adhered around the reinforcing thread, whereby the cable core element for winding the conductive wire is formed, the conductive wire having a given diameter. The method further includes winding the conductive wire around the cable core portion with a given number of spirals, the conductive wire including a wire core portion and a semi-electroconductive wire-coating, and covering the cable core element, wound with the conductive wire, with an insulating coating.

In the above described method, the diameter of the conductive wire is configured to be about 40 μm at the most, whereas the diameter of the cable core element is configured to be about 0.75 mm at the most. The number of spirals is then set to be at least about 12,000 spirals/m.

In the above method, the cable core element wound with the conductive wire is preferably covered with an inner coating having a semi-electroconductivity. Then, the inner coating is further covered with the insulating coating.

BRIEF DESCRIPTION OF THE DRAWINGS

The above and other objects, features and advantages of the present invention will be made apparent from the following description of the preferred embodiments, given as non-limiting examples, with reference to the accompanying drawings, in which.

1. common cable subjected to no noise-suppression treatments;
2. cable according to prior art 1;
3. cable according to prior art 2;
4. cable according to the present invention.

DETAILED DESCRIPTION OF THE PREFERRED EMBODIMENTS

Figure 1:
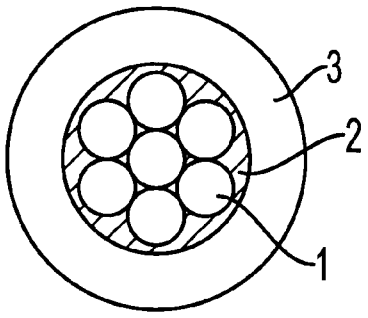
FIG. 1 (PRIOR ART)
FIG. 1 is a transversal cross-sectional view of an electrical cable for high-voltage circuits according to prior art 3.
Figure 2:
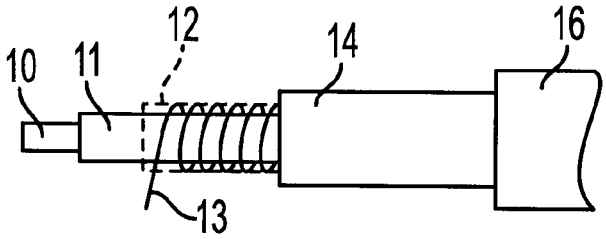
FIG. 2 is a side view of a portion of electrical cable for high-voltage circuits according to the embodiments of the present invention.

FIG. 2 shows an electrical cable for high-voltage circuits according to a first embodiment of the present invention. The cable is manufactured by: preparing a reinforcing fibrous thread 10; baking and adhering a fluorocarbon rubber paint mixed with ferrite powder (magnetic material) around the reinforcing thread 10, thereby forming a cable core element 11 having a small diameter; winding an electrically conductive wire 13 around the cable core element 11; extruding an insulating coating 14 on the wound conductive wire 13 and the cable core element 11; and covering the insulating coating 14 with a sheath 16. In a preferred embodiment, a conductive inner coating 12 is formed by extrusion after the conductive wire 13 has been wound around the cable core element, but before the insulating coating 14 is formed by extrusion. This conductive inner coating 12 may be an inner coating having a semi-electroconductivity.

In particular, the conductive wire 13 may include a wire core portion 13*a* and a semi-electroconductive wire-coating 13*b*. By applying such a semi-electroconductive wire-coating 13*b*, the conductive wire 13 may be wound more densely. As a result, the diameter of the electrical cable may be made thinner, while maintaining a high noise resistance.

The reinforcing thread 10 is made of an aramide fiber, a glass fiber or the like. In one example, three fibers each having a weight density per unit of about 1,000 deniers are twisted into a reinforcing thread 10 having a diameter of about 0.6 mm.

The fluorocarbon rubber paint used for making the cable core element 11 is applied as the so-called "baking paint". The reinforcing thread 10 is soaked in a liquid fluorocarbon rubber paint. Then, the resultant soaked thread is put into a heating furnace for drying, and baked at a temperature ranging from about 70° C. to about 250° C. The fluorocarbon rubber paint may be blended with a reinforcing polymer. The reinforcing polymer includes a copolymer of ethylene and vinyl acetate (EVA) which is compatible with the fluorocarbon rubber paint. Moreover, ethylene and vinyl acetate of the copolymer are simultaneously vulcanized during the vulcanization process. Usually, EVA is blended in an amount ranging from about 5 to about 25 parts by weight, relative to about 100 parts by weight of fluorocarbon rubber paint. By applying the baking process to fluorocarbon rubber paints, thinner coatings for electrical cables can be obtained For example, for a cable core element 11 including the fluorocarbon rubber paint, its diameter will be made as thin as about 0.55 mm. Usually, when winding a conductive wire 13 around the cable core element 11, a certain degree of stress is caused. However, by virtue of this thin diameter structure, this stress creates little strain so that the wound conductive wire maintains its proper circular shape and undergoes no flat crushing. By using such a conductive wire, the thickness of insulating coating can be made uniform. Consequently, the electrical cable using such a conductive wire and insulating coating acquires an improved electrical voltage breakdown resistance.

The ferrite powder used in the cable core element 11 includes, for example, a Mn—Zn type ferrite, e.g. manganese-zinc-iron oxides (Mn—Zn—Fe oxides). The ferrite powder is mixed in an amount of about 40 to about 90 parts by weight, relative to about 100 parts by weight of fluorocarbon rubber paint.

The conductive inner coating 12 is shown with dotted lines in FIG. 2. This coating may be formed by using the same type of polyethylene resin as the one used for the insulating coating 14. The resin is then mixed with carbon or the like, to give a semi-electroconductivity. The conductive inner coating 12 may be prepared by simultaneously extruding with the insulating coating 14 described below.

The conductive wire 13 may be a nickel-chromium wire, the surface of which is covered with a semi-electroconductive wire-coating, giving a total diameter of about 40 μm. The conductive wire 13 is wound around the cable core element 11 prior to vulcanization, with a pitch of at least about 12,000 spirals/m, e.g., about 15,000 spirals/m. The semi-electroconductive wire-coating, that makes up the conductive wire 13, is formed by kneading carbon black into a resin such as polyurethane. The film resistance value thereof is about 10 to about $10^3$ Ω. As the surface of the conductive wire 13 is covered with a semi-electroconductive wire-coating, stripping off the wire-coating becomes no longer necessary when preparing cable's end portions. Preparation of the electrical cable is thus made easier. Further, by virtue of this semi-electroconductive wire-coating, the winding pitch of conductive wire 13 can be set tighter, thereby increasing the winding number to e.g., about 15,000 spirals/m. The increased winding number gives an improved anti-noise effect.

Figure 3:
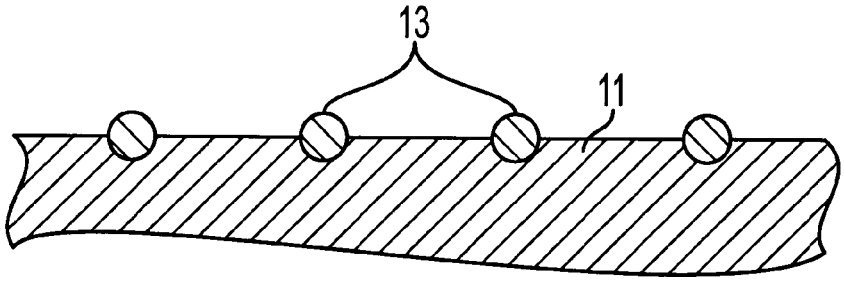
FIG. 3 is a longitudinal cross-sectional view of the cable core element of the electrical cable of FIG. 2, in which the conductive wire is wound onto the cable core element.

As shown in FIG. 3, the conductive wire 13 penetrates into the cable core element 11 to an extent corresponding to at least about 5%, and preferably more than about 50%, of the diametrical height of conductive wire 13, measured on the plane perpendicular to the surface of cable core element 11. This partially embedded state is maintained during subsequent vulcanization treatments, which are carried out at about 160° C. for about 30 minutes. As the diameter of cable core element 11 is set at about 0.55 mm, the external diameter thereof after the conductive wire 13 is wound will be about 0.6 mm.

In order to improve the electrical breakdown resistance, the insulating coating 14 may include a cross-linked, flexible polyethylene having a melting point of at least about 120° C. and containing no additives such as flame retarders. In practice, the insulating coating 14 is manufactured by simultaneously extruding with the conductive inner coating 12. By virtue of this co-extrusion, both coatings are firmly adhered. As a result, the electrical breakdown resistance of the cable is improved. Further, when stripping off the coating ends, the conductive inner coating 12 and the insulating coating 14 can be removed at the same time by one single procedural step. The insulating coating 14 is usually set to have a thickness of about 0.3 to about 0.7 mm, e.g., about 0.65 mm, and an external diameter of about 2.6 mm.

The sheath 16 is made of an insulating resin such as poly(vinyl chloride). The thickness of sheath 16 is set to be about the same as, or slightly greater than, that of insulating coating 14, e.g., about 0.75 mm, whilst its outer diameter is about 4.1 mm. By contrast with high-voltage cables used in the automobile industry, the sheath 16 used in the field of the invention is not required to have high temperature resistance, such as in a temperature range of about 180 to about 200° C. The sheath 16 need only be heat-resistant to about 105° C. at the most. The material for sheath 16 can thus be chosen from a wider range of products. It is often selected from among flexible products.

The electrical cable for high-voltage circuits has a similar structure to that of high-tension cables for automobiles. However, in high-tension cables for automobiles, the diameter of a conductive wire that is wound around a cable core element 11 is about 50 to about 60 $\mu$m, and its winding density is about 1,000 to about 5,000 spirals/m. By comparison, with electrical cables for high-voltage circuits used in fixed apparatuses, the diameter of conductive wire 13 is set to about 40 $\mu$m. Further, by applying a semi-electroconductive wire-coating, the winding pitch can be set denser, such that a winding number of about 15,000 spirals/m can be obtained. This increased winding number serves to improve anti-noise characteristics of the electrical cable.

The reason for using a thicker conductive wire (about 50 to about 60 $\mu$m) in automobiles is, firstly, that the wire must resist vibrations due to automotive movements, and, secondly, that the wire must carry longer wiring paths, so as to secure reliability in the wiring system. Accordingly, spiral pitches for the conductive wire are set to be rather broad in automobiles, so as to prevent the spirals from being stacked or superposed when the high-voltage cable is wound. On the other hand, the electrical cable for high-voltage circuits according to the present invention is used in fixed type apparatuses, such as office machinery and tools, or home appliances, which are installed in a fixed or immobile state. Accordingly, the conductive wire 13 can be made thinner without the need to take vibration problems into account. This is a marked difference with respect to high-tension cables used in automobiles. Spiral pitches can thus be set denser, without risk of stacking, even if the wiring procedure of the electrical cable, which is performed via flexing, is taken into account.

Further, in high-tension cables for common automobiles, the mixing amount of ferrite powder in the cable core element 11 ranges from about 300 to about 500 parts by weight, relative to about 100 parts by weight for the rest, i.e., about 75 to about 83% by weight. On the other hand, in the electrical cables for high-voltage circuits according to the invention, this amount is set to be in the range of about 40 to about 90 parts by weight, relative to about 100 parts by weight of fluorocarbon rubber paint.

Usually, the impedance (resistance) tends to increase proportionally with the square of the number of spirals of the conductive wire. Accordingly, the impedance is commonly set to be between about 16 and about 19 kΩ/m in the case of high-tension cables for automobiles. By contrast, the impedance is set higher, i.e. in the range of about 30 to about 35 kΩ/ m, in the electrical cable for high-voltage circuits according to the present invention.

Further yet, by using the fluorocarbon rubber paint as a baking-and-adhering paint, the coating thereof can be made thinner, whilst maintaining a high noise-suppressing capacity. As a result, the diameter of the cable core element 11, including the fluorocarbon rubber paint, can be rendered as thin as about 0.55 mm. In addition, by making a thinner coating, the strain (crushing) generated by the stress, when winding the conductive wire 13, is rendered almost nil, so that a properly round conductive wire 13 can be manufactured. Using such a conductive wire 13, the thickness of insulating coating 14 can be made even. As a result, an electrical cable made by applying such an insulating coating 14 has an improved electrical voltage breakdown resistance.

Figure 4:
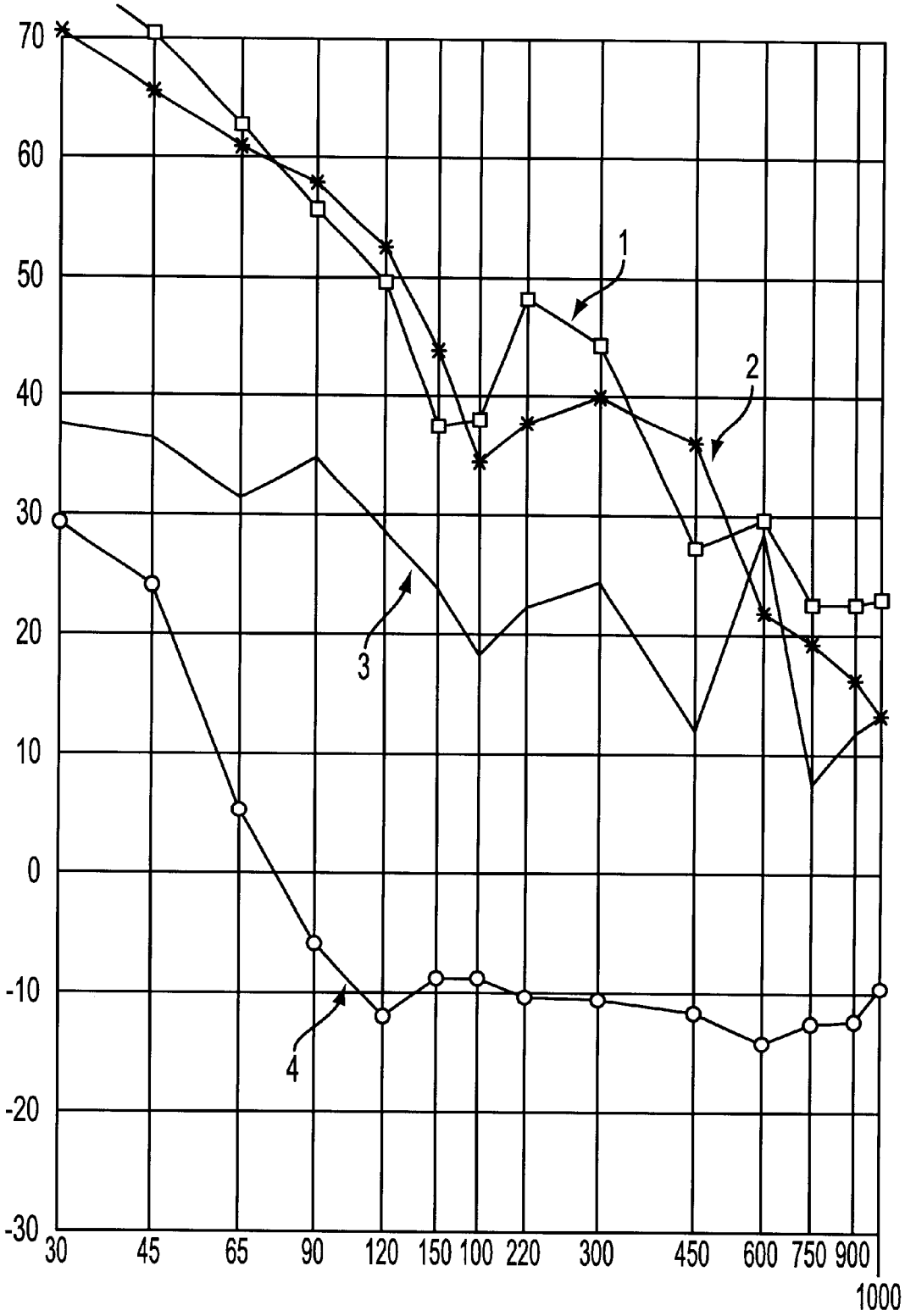
FIG. 4 shows the wavelength-dependent distribution curves of high-voltage noise (abscissa: frequency zone in MHZ; ordinate: noise penetration level in dBμA), measured for each of the following cables.
Figure 5:
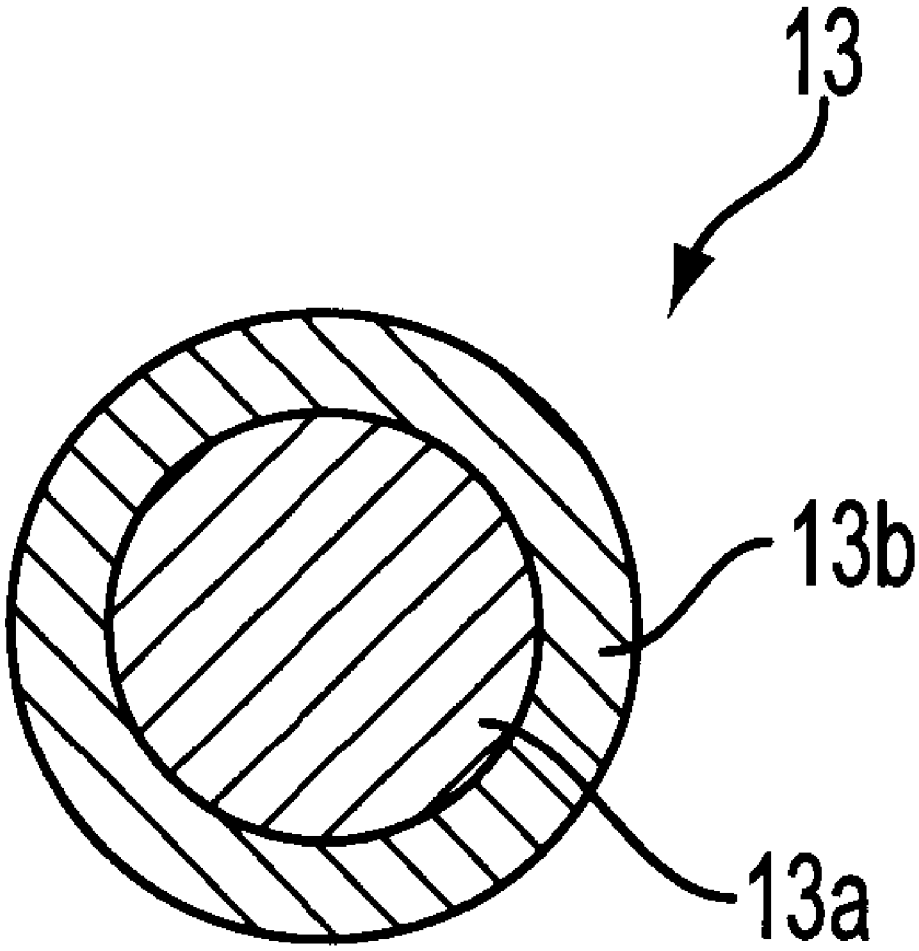
FIG. 5 depicts a cross-section of a conductive wire including a wire core portion and a semi-electroconductive coating according to an aspect of the present invention.

Tests for high-voltage noise have been carried out for several types of cables in a frequency range of 30 to 1,000 MHZ. The results of the tests are shown in FIG. 4, in which the abscissa represents frequencies (MHZ) and the ordinate represents noise penetration levels (dB$\mu$A). Numerals 1, 2, 3 and 4 in this figure respectively refer to, respectively: a common electrical cable for which no noise-prevention treatments are applied (common cable), a cable according to prior art (common cable provided with a ferrite core), a cable according to prior art 2 (cable having an impedance of 10 kΩ), and an electrical cable for high-voltage circuits according to the invention. As can be seen in FIG. 4, the cable according to the invention has the lowest noise levels among the above-mentioned cables, indicating that the greatest noise-reduction effect is obtained with the cable according to the invention.

In order to be used for wiring inside office appliances, a cable must satisfy a number of prerogatives. The electrical cable according to the invention gives satisfactory results in tests for high-voltage breakdown resistance, for noninflammability and for the so-called cutting-through performance under high voltage, which are defined by UL Standards.

Furthermore, the conductive wire 13 is wound around the cable core element 11 while penetrating partially into the latter. By virtue of this configuration, the wound conductive wire 13 is prevented from shifting. Usually, when winding the conductive wire 13 around the cable core element 11, or connecting an end portion of the electrical cable for high-voltage circuits to a terminal metal part, the electrical cable is subjected to peeling or folding stresses. Even in such cases, the inventive conductive wire 13 is no longer susceptible to loosening by these types of stress. Shifting of the spiral pitches or breakage of the conductive wire can thus be avoided.

It should be noted that the dimensions concerning the cables and their portions and components mentioned above are cited merely as examples, and should not be construed as limiting. For example, a fiber may have a weight density per unit of about 400 deniers, and three such fibers may be twisted into a reinforcing thread 10 having a diameter of about 0.4 mm. In such a case, in order to maintain the resistance of the cable core element 11, the diameter thereof is preferably set to be about 0.75 mm. Also, the diameter of the conductive wire 13 may be set to be about 0.8 mm.

In each of the above embodiments, the insulating coating 14 is made of polyethylene. However, it can also be made of other soft dielectric resins such as silicone.

Further, the wound conductive wire 13 is successively covered with an insulating coating 14 and a sheath 16. In such a structure, the sheath 16 may be made of an insulating material. Also, the interface between the conductive wire 13 and the insulating coating 14 may be filled with a semi-electroconductive material having high-resistivity, which can be made by mixing conductive particles.

In the electrical cable for high-voltage circuits used in fixed type office apparatuses or home appliances or the like, the diameter of the conductive wire is set to be about 40 $\mu$m, and the conductive wire comprises a semi-electroconductive wire-coating. These measures enable a dense winding pitch of the conductive wire, such that a winding number of at least about 12,000 spirals/m can be obtained. This increased winding number allows the electrical cable to improve the noise-suppressing effect. For example, a winding number of about 15,000 spirals/m gives a high noise-suppression effect.

As the fluorocarbon rubber paint is used for baking, the coating made therefrom can be rendered thinner, while maintaining a high noise-suppressing effect. As a result, the diameter of the cable core portion including the fluorocarbon rubber paint can be rendered as thin as, e.g., about 0.75 mm. In such a construction, there is little strain (collapse) exerted by the stress when winding the conductive wire, so that a properly round conductive wire can be made. By using such a conductive wire, the thickness of the insulating coating is rendered even. Consequently, electrical voltage breakdown resistance can be improved.

Although the invention has been described with reference to particular means, materials, and embodiments, it is to be understood that the invention is not limited to the particulars disclosed and extends to all equivalents within the scope of the claims.

The present disclosure relates to subject-matter contained in priority Japanese Application No. HEI-10-197331, filed on Jul. 13, 1998, which is herein expressly incorporated by reference in its entirety.

What is claimed:

1. An electrical cable for high-voltage circuits in fixed-type apparatuses, said electrical cable comprising:

a reinforcing thread;

a cable core element for winding an electrically conductive wire therearound, said cable core element including a baked fluorocarbon rubber paint mixed with a magnetic material, such that said fluorocarbon rubber paint mixed with said magnetic material is adhered around said reinforcing thread, and wherein said cable core element has a diameter of about 0.75 mm at the most;

said electrically conductive wire comprising a nickel-chromium wire core portion and a semi-electroconductive wire-coating, said semi-electroconductive wire-coating having a film resistance value of about 10 to about $10^3$ Ω, and said conductive wire wound around said cable core element with a given number of spirals; and an insulating coating covering said conductive wire;

said conductive wire having a diameter of about 40 $\mu$m at the most and said number of spirals being at least about 12,000 spirals/m, such that said electrical cable for high-voltage circuits in fixed-type apparatuses has an impedance in the range of about 30 to about 35 kΩ/m.

2. The electrical cable for high-voltage circuits according to claim 1, further comprising an inner coating having a semi-electroconductivity, said inner coating being located between said cable core element wound with said conductive wire and said insulating coating.

3. The electrical cable for high-voltage circuits according to claim 1, wherein said number of spirals is about 15,000 spirals/m.

4. The electrical cable for high-voltage circuits according to claim 2, wherein said number of spirals is about 15,000 spirals/m.

* * * * *